US007398039B2

(12) United States Patent
Ishii

(10) Patent No.: US 7,398,039 B2
(45) Date of Patent: Jul. 8, 2008

(54) CARTRIDGE, IMAGE FORMING APPARATUS AND TONER AGITATION MEMBER

(75) Inventor: Masahiro Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 136 days.

(21) Appl. No.: 11/201,132

(22) Filed: Aug. 11, 2005

(65) Prior Publication Data

US 2006/0034644 A1 Feb. 16, 2006

(30) Foreign Application Priority Data

Aug. 11, 2004 (JP) ..... 2004-234515

(51) Int. Cl.
*G03G 15/08* (2006.01)

(52) U.S. Cl. ..... 399/263

(58) Field of Classification Search ..... 399/254, 399/255, 256, 258, 262, 263
See application file for complete search history.

(56) References Cited

U.S. PATENT DOCUMENTS

| | | | |
|---|---|---|---|
| 5,729,804 | A | 3/1998 | Aruga et al. |
| 6,337,964 | B2 | 1/2002 | Inami et al. |
| 6,385,422 | B1 | 5/2002 | Ishiguro et al. |
| 6,456,810 | B1 | 9/2002 | Deguchi et al. |
| 2002/0150410 | A1 | 10/2002 | Matsuda et al. |

FOREIGN PATENT DOCUMENTS

| | | |
|---|---|---|
| EP | 1345091 | 9/2003 |
| GB | 2257534 | 1/1993 |
| JP | 7104572 | 4/1995 |
| JP | 9-21195 | 8/1997 |
| JP | 11249398 | 9/1999 |
| JP | 2000231249 | 8/2000 |
| JP | 2000-250296 | 9/2000 |
| JP | 2001100501 | 4/2001 |
| JP | 2002214891 | 7/2002 |
| JP | 2001134060 | 2/2008 |

OTHER PUBLICATIONS

European Patent Office Communication for Application No. 05 017 509.0-2209, dated Aug. 24, 2007, 3 pages.
Chinese Office Action for Application No. 2005100926171 mailed Nov. 30, 2007.

*Primary Examiner*—Hoang Ngo
(74) *Attorney, Agent, or Firm*—Banner & Witcoff, Ltd.

(57) ABSTRACT

A toner agitation member includes a connection portion provided to be rotated around a rotation shaft within a toner storage chamber and extending radially outwards from the rotation shaft, and an agitation plate, provided at a distal end of the connection portion, for scraping a toner deposited on a bottom of the toner storage portion and supplying it to a toner supply opening provided in the toner storage chamber as the connection portion is rotated. The connection portion and the agitation plate are integrally formed of the same material.

16 Claims, 10 Drawing Sheets

CARTRIDGE, IMAGE FORMING APPARATUS AND TONER AGITATION MEMBER

BACKGROUND OF THE INVENTION

1. Field of the Invention

The present invention relates to a cartridge, an image forming apparatus, and a toner agitation member.

2. Description of the Related Art

In an image forming apparatuses of electrophotography method such as a laser printer, a thin layer of toner is formed on a developing roller by bringing a layer thickness regulating blade into pressure contact with the developing roller. An electrostatic latent image on a photosensitive member is visualized as a toner image with the toner of the thin layer, and this visualized toner image is then transcribed onto a sheet.

For instance, in an image forming apparatus disclosed in JP-A-2001-100501, a toner storage chamber is provided adjacent to a developing chamber where a developing roller is provided. In the toner storage chamber, an agitator (toner agitation member) for agitating the toner and supplying the toner to an opening portion that communicates with the developing chamber is provided to be rotated and driven within the toner storage chamber. This agitator has a support member made of ABS (Acrylonitrile-Butadiene-Styrene) resin and formed integrally around a rotation shaft. A flexible film formed of PET, etc., and having a thickness of 100 μm is attached at a distal end portion of the support member. When the support member is rotated and driven, the film slides on an inner wall surface of the toner storage chamber with a flexural deformation, and when the film arrives at the opening portion, the film is restored, expelling the toner through the opening portion to the developing chamber.

SUMMARY OF THE INVENTION

However, in the above-described structure, since the film is attached to the support member, the number of parts is increased, causing the manufacturing cost to be increased due to the labor for assembling and the expenses of parts.

This invention provides a toner agitation member, a cartridge and an image forming apparatus in which the number of parts is reduced to suppress the manufacturing cost.

According to an aspect of the invention, there is provided a toner agitation member including: a connection portion provided to be rotated around a rotation shaft within a toner storage chamber and extending radially outwards from the rotation shaft; and an agitation plate, provided at a distal end of the connection portion, for scraping a toner deposited on a bottom of the toner storage chamber and supplying it to a toner supply opening provided in the toner storage chamber as the connection portion is rotated. The connection portion and the agitation plate are integrally formed of the same material.

According to another aspect of the invention, there is provided a cartridge including: the toner agitation member described above; and a toner storage chamber provided with a toner supply opening.

According to still another aspect of the invention, there is provided an image forming apparatus including: the toner agitation member described above; a toner storage chamber provided with a toner supply opening; an image carrier on which an electrostatic latent image is formed; an exposure unit for exposing the electrostatic latent image by applying a laser beam to the charged image carrier; a developing unit for developing the electrostatic latent image formed on the image carrier as a toner image with the toner supplied through the toner supply opening; and a transfer unit for transferring the toner image carried on the image carrier onto a recording medium.

Since the toner agitation member has the agitation plate for agitating and supplying the toner and the connection portion for connecting the agitation plate with the rotation shaft, which are integrally formed of the same material, the number of parts is reduced to suppress the manufacturing cost required for assembling the parts.

BRIEF DESCRIPTION OF THE DRAWINGS

The present invention may be more readily described with reference to the accompanying drawings.

DETAILED DESCRIPTION OF THE PREFERRED EMBODIMENTS

First Embodiment

Referring to FIGS. 1 to 8, a first embodiment of the present invention will be described below.

Figure 1:
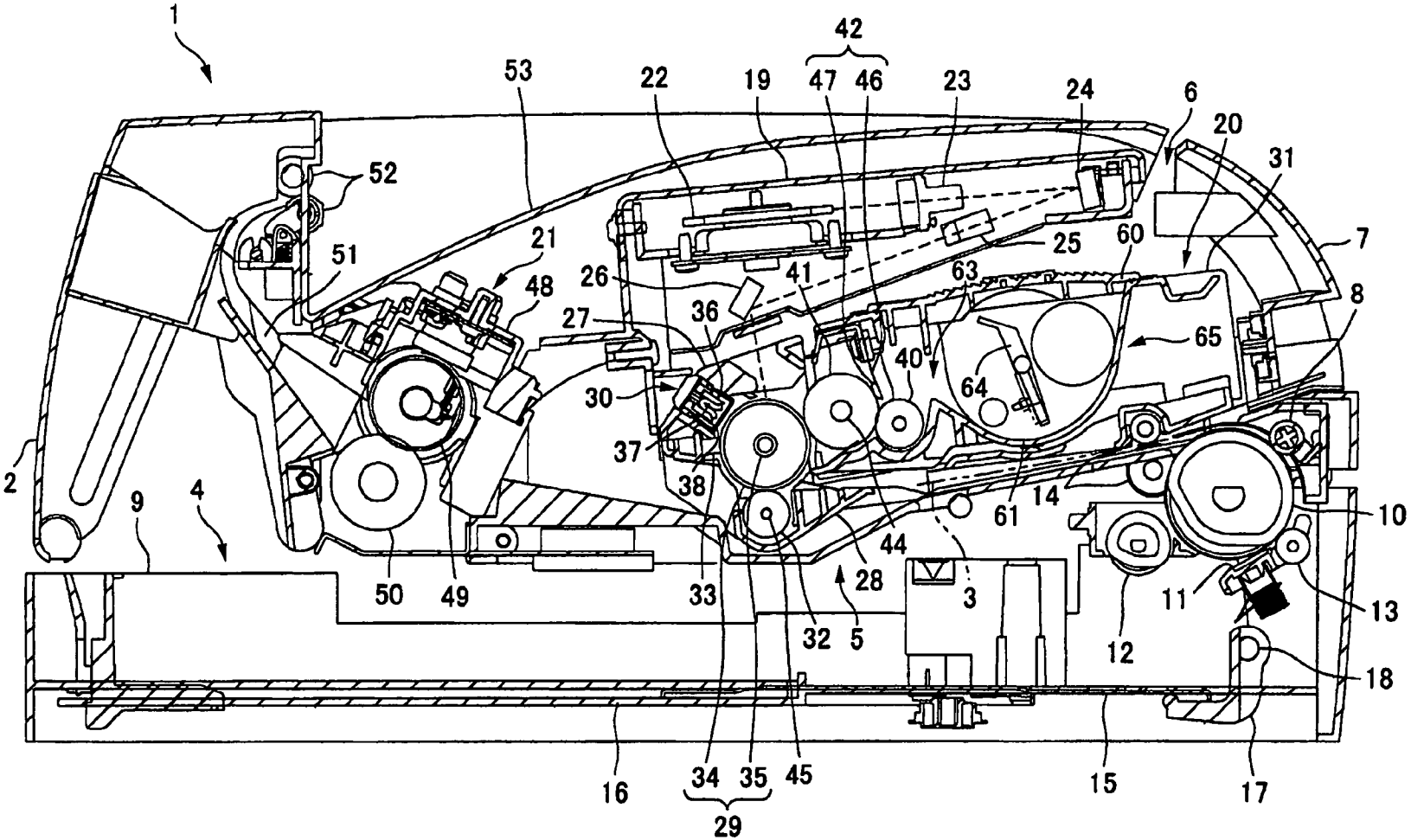
FIG. 1 is a side cross-sectional view showing a laser printer as an image forming apparatus according to a first embodiment of the present invention, in a state where a front cover is closed.
Figure 2:
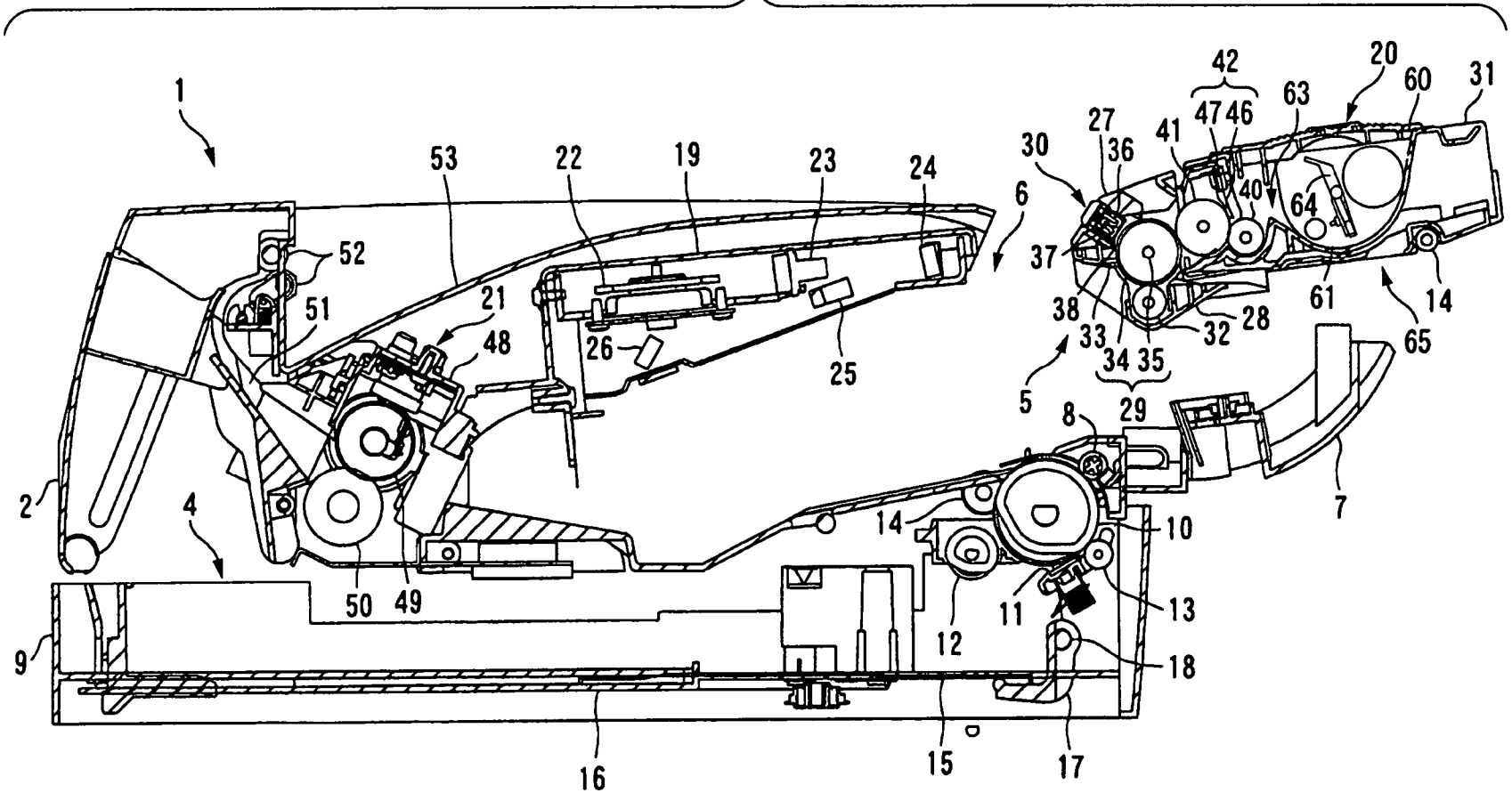
FIG. 2 is a side cross-sectional view showing the laser printer shown in FIG. 1, in a state where the front cover is opened.

FIGS. 1 and 2 are side cross-sectional views showing a laser printer as an image forming apparatus according to an embodiment of the invention. This laser printer 1 has a main body casing 2, a feeder portion 4 accommodated within the main body casing 2 for feeding a sheet 3 as a recording medium, and an image forming portion 5 for forming an image on the fed sheet 3.

On one wall of the main body casing 2, a cartridge access opening 6 for mounting or dismounting a process cartridge 20 is formed, and a front cover 7 for opening or closing the opening 6 is provided. The front cover 7 is rotatably supported around a cover shaft (not shown) inserted through its lower end part. Thereby, when the front cover 7 is closed around the cover shaft, the cartridge access opening 6 is closed by the front cover 7 as shown in FIG. 1. When the front cover 7 is opened (inclined) around the cover shaft as a fulcrum, the cartridge access opening 6 is opened as shown in FIG. 2, whereby the process cartridge 20 can be mounted or dismounted through this cartridge access opening 6 on or from the main body casing 2. For the sake of convenience, the side where the front cover 7 is provided (the right side in FIG. 1) is called "front side," and the opposite side (the left side in FIG. 1) is called "rear side."

The feeder portion 4 has a sheet feed tray 9 that is removably attached on the bottom of the main body casing 2, a sheet feeding roller 10 and a separation pad 11 provided above a front end part of the sheet feed tray 9, a pickup roller 12 provided in the rear of the sheet feeding roller 10, a pinch roller 13 disposed oppositely downward in front of the sheet feed roller 10, a paper powder removal roller 8 disposed oppositely upward in front of the sheet feeding roller 10, and a registration roller 14 provided upward in the rear of the sheet feeding roller 10.

A sheet pressing plate 15 on which the sheet 3 is stacked is provided inside the sheet feed tray 9. This sheet pressing plate 15 is supported swingably at the rear end part, and can be swung between a laying position along a bottom plate 16 of the sheet feed tray 9 where the front end part is placed downward and a conveying position with inclination where the front end part is placed upward.

At the front end part of the sheet feed tray 9, a lever 17 for lifting up the front end part of the sheet pressing plate 15 is provided. This lever 17 is formed like L-character in section and is inserted from the front side of the sheet pressing plate 15 to the lower side of the sheet pressing plate 15, with its upper end part being affixed to a lever shaft 18 provided at the front end part of the sheet feed tray 9, and its rear end part being in contact with the front end part of the lower face of the sheet pressing plate 15. Thereby, when a rotational driving force clockwise in the figure is inputted to the lever shaft 18, the lever 17 is rotated around the fulcrum of the lever shaft 18, causing the rear end part of the lever 17 to lift up the front end part of the sheet pressing plate 15 to locate the sheet pressing plate 15 at the conveying position.

When the sheet pressing plate 15 is located at the conveying position, the sheet 3 on the sheet pressing plate 15 is pressed against the pickup roller 12, and is conveyed between the sheet feeding roller 10 and the separation pad 11 along with the rotation of the pickup roller 12.

On the other hand, when the sheet feed tray 9 is separated away from the main body casing 2, the front end part of the sheet pressing plate 15 moves down due to its dead weight, so that the sheet pressing plate 15 is located at the laying position. When the sheet pressing plate 15 is located at the laying position, the sheet 3 can be stacked on the sheet pressing plate 15.

The sheet 3 fed between the sheet feeding roller 10 and the separation pad 11 by the pickup roller 12 is securely treated one-by-one, when put between the sheet feeding roller 10 and the separation pad 11, and fed by the rotation of the sheet feeding roller 10. The fed sheet 3 is passed between the sheet feeding roller 10 and the pinch roller 13, and then conveyed to the registration roller 14 after paper powder is removed by the paper powder removal roller 8.

The registration roller 14 is composed of a pair of rollers, which register the sheet 3, and then convey it to a transfer position between a photosensitive drum 29 and a transfer roller 32, where the toner image on the photosensitive drum 29 is transferred onto the sheet 3.

The image forming portion 5 has a scanner portion 19 as an exposure unit, a process cartridge 20 and a fixing portion 21.

The scanner portion 19 is provided on the upper part within the main body casing 2, and has a laser light source, not shown, a polygon mirror 22 that is rotated and driven, an of lens 23, a reflecting mirror 24, a lens 25 and a reflecting mirror 26. A laser beam emitted from the laser light source based on the image data is deflected by the polygon mirror 22 to pass through the fθ lens 23, bent back in the optical path by the reflecting mirror 24 to pass through the lens 25, bent down in the optical path by the reflecting mirror 26, and applied on the surface of the photosensitive drum 29 of the process cartridge 20, as indicated by the chain line.

Figure 3:
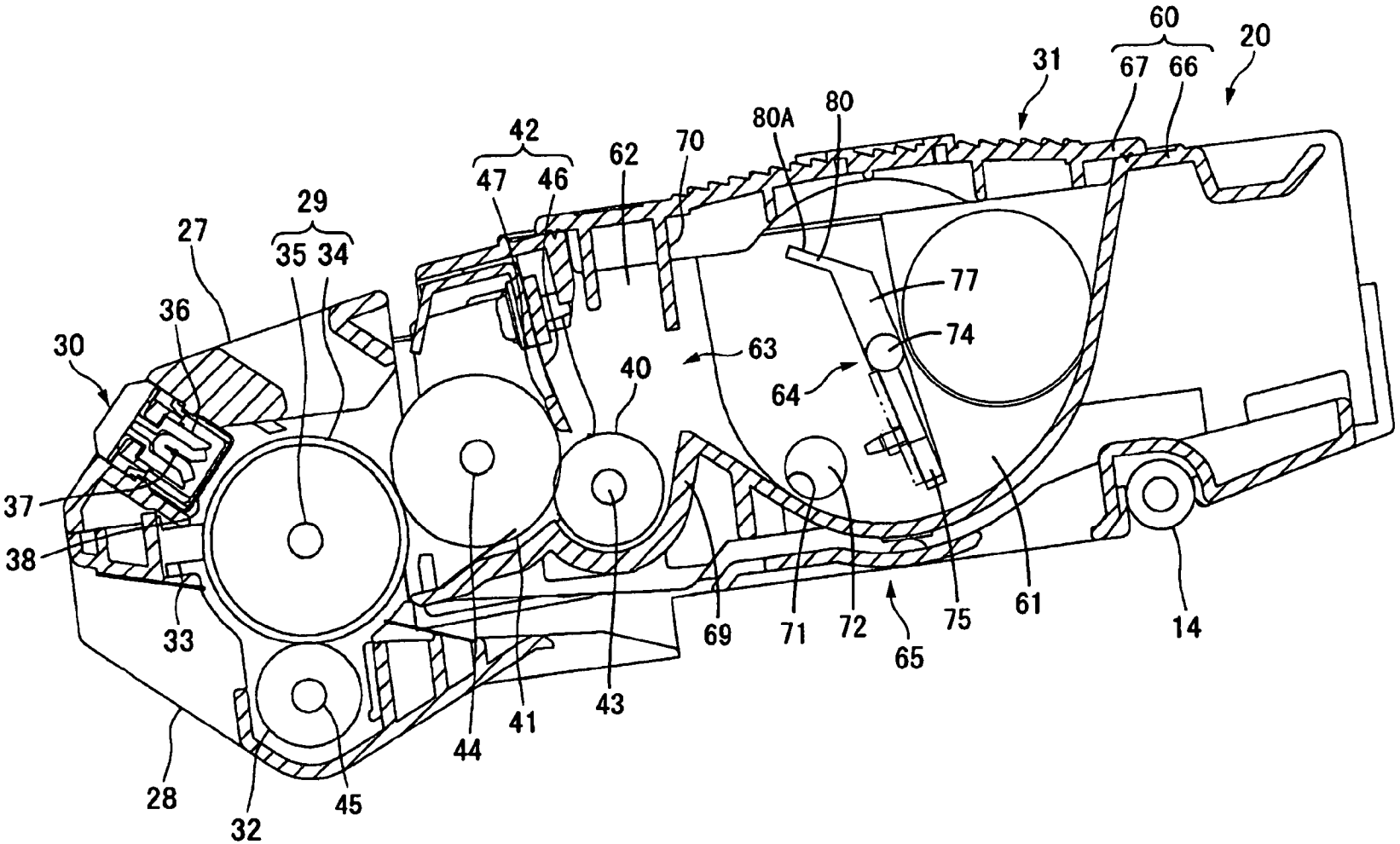
FIG. 3 is a side cross-sectional view of a process cartridge.

FIG. 3 is a side cross-sectional view of the process cartridge 20. This process cartridge 20 is detachably attached to the main body casing 2 under the scanner portion 19. The process cartridge 20 has, as a housing, an upper frame 27 as a first frame and a lower frame 28 as a second frame that is formed separately from the upper frame 27 and combined with the upper frame 27, as shown in FIG. 3. Also, the process cartridge 20 has, within the housing, the photosensitive drum 29 as an image carrier, a Scorotron type charger 30 as a charging unit, a developer cartridge 31, a transfer roller 32 as a transfer unit, and a cleaning brush 33.

The photosensitive drum 29 is shaped like a cylinder, and has a drum main body 34 of which the top surface layer is formed of a positively charged photosensitive layer made of polycarbonate, and a metallic drum shaft 35 as a shaft extending along a longitudinal direction of the drum main body 34 in the shaft center of the drum main body 34. The drum shaft 35 is supported on the upper frame 27, and the drum main body 34 is supported rotatably around the drum shaft 35, whereby the photosensitive drum 29 is provided rotatably around the drum shaft 35 in the upper frame 27.

The Scorotron type charger 30 is supported on the upper frame 27, and disposed obliquely upward in the rear of the photosensitive drum 29 and opposed to the photosensitive drum 29, with a predetermined spacing from the photosensitive drum 29 to be out of contact. This Scorotron type charger 30 has a discharge wire 37 disposed opposite the photosensitive drum 29 with a predetermined spacing, and a grid 38 provided between the discharge wire 37 and the photosensitive drum 29 for controlling the amount of discharge from the discharge wire 37 to the photosensitive drum 29. This Scorotron type charger 30 corona discharges the discharge wire 37 by applying a bias voltage to the grid 38 as well as applying a high voltage to the discharge wire 37, and thereby charges uniformly the surface of the photosensitive drum 29 in positive polarity.

This Scorotron type harger 30 is provided with a cleaning member 36 for cleaning the discharge wire 37 which holds the discharge wire 37 in between.

The developer cartridge 31 is detachably attached to the lower frame 28. The developer cartridge 31 has an accommodation case 60 like a box in which the rear side is opened, and is internally formed with a toner storage chamber 61 on the front side and a developing chamber 62 on the rear side. Both the chambers are communicated through a toner supply opening 63.

Within the toner storage chamber 61, the positively charged toner including a non-magnetic component is filled as the developer. This toner for use may be polymer toner produced by copolymerizing polymeric monomer, for example, styrene based monomer such as styrene, or acryl based monomer such as acrylic acid, alkyl (C1 to C4) acrylate or alkyl (C1 to C4) methacrylate, by suspension polymerization. Such polymer toner is almost spherical, has very excellent fluidity, and achieves the image formation of high image quality.

Such toner is mixed with a coloring agent such as carbon black or a wax, and an additive agent such as silica is added to improve fluidity. The average particle diameter of the toner is about 6 to 10 mm.

Also, an agitator 64 is provided as a toner agitation member within the toner storage chamber 61. This agitator 64 is rotated and driven by inputting a motive force from a motor, not shown, agitating the toner within the toner storage chamber 61 along with the rotation, and discharging the toner through the toner supply opening 63 toward the developing chamber 62. The toner storage chamber 61 and the toner supply opening 63 of the accommodation case 60 and the agitator 64 constitute a toner agitation device 65. The constitution of the toner agitation device 65 will be described later in detail.

Within the developing chamber 62, a supply roller 40, a developing roller 41 as a developing unit and a layer thickness regulating blade 42 are provided.

The supply roller 40 is disposed on a lower portion behind the toner supply opening 63 and rotatably supported in the accommodation case 60 of the developer cartridge 31. This supply roller 40 is constituted by covering a metallic roller shaft 43 with a roller made of conductive foaming material. This supply roller 40 is rotated and driven by inputting a motive force from the motor, not shown.

The developing roller 41 is rotatably supported in the accommodation case 60 of the developer cartridge 31 in a state where it is in contact with the supply roller 40 to be mutually compressed in the rear of the supply roller 40. Also, the developing roller 41 is oppositely in contact with the photosensitive drum 29 in a state where the developer cartridge 31 is mounted on the lower frame 28. This developing roller 41 is constituted by covering a metallic roller shaft 44 with a roller made of conductive rubber material. The roller of the developing roller 41 is covered with a coat layer of urethane rubber or silicone rubber containing fluorine on the surface of a roller main body made of conductive urethane rubber or silicone rubber containing carbon particles. A developing bias is applied to the developing roller 41 at the time of development. Also, the developing roller 41 is rotated and driven in the same direction as the supply roller 40 by inputting a motive force from the motor, not shown.

The layer thickness regulating blade 42 has a pressing portion 47, semicircular in cross section, made of insulating silicone rubber at the distal end part of a blade main body 46 made from a metallic leaf spring. This layer thickness regulating blade 42 is supported in the accommodation case 60 of the developer cartridge 31 above the developing roller 41, and the pressing portion 47 is pressed against the developing roller 41 due to a resilient force of the blade main body 46.

The toner discharged through the toner supply opening 63 into the developing chamber 62 is supplied to the developing roller 41 with the rotation of the supply roller 40, and then positively charged due to friction between the supply roller 40 and the developing roller 41. The toner supplied onto the developing roller 41 enters between the pressing portion 47 of the layer thickness regulating blade 42 and the developing roller 41 along with the rotation of the developing roller 41 and is borne on the developing roller 41 as a thin layer having a predetermined thickness.

The transfer roller 32 is rotationally supported on the lower frame 28, and is disposed to form a nipping portion with the photosensitive drum 29 by being brought into contact with the photosensitive drum 29 vertically oppositely in a state where the upper frame 27 and the lower frame 28 are combined. This transfer roller 32 is constituted by covering a metallic roller shaft 45 with a roller made of conductive rubber material. A transfer bias is applied to the transfer roller 32 at the time of transfer. Also, the transfer roller 32 is rotated and driven in the opposite direction of the photosensitive drum 29 by inputting a motive force from the motor, not shown.

The cleaning brush 33 is attached on the lower frame 28, and disposed oppositely in contact with the photosensitive drum 29 in the rear of the photosensitive drum 29 in a state where the upper frame 27 and the lower frame 28 are combined.

The surface of the photosensitive drum 29 is first positively charged uniformly by the Scorotron type charger 30 along with the rotation of the photosensitive drum 29, and then exposed by fast scanning of a laser beam from the scanner portion 19 to form an electrostatic latent image corresponding to the image to be formed on the sheet 3.

Subsequently, when the positively charged toner borne on the developing roller 41 oppositely contacts the photosensitive drum 29 along with the rotation of the developing roller 41, the toner is supplied to the electrostatic latent image formed on the surface of the photosensitive drum 29, or an exposed portion exposed by the laser beam and having a lower potential on the uniformly, positively charged surface of the photosensitive drum 29. Thereby, the electrostatic latent image of the photosensitive drum 28 is visualized, and a toner image is borne by reversal development on the surface of the photosensitive drum 29.

Thereafter, the toner image borne on the surface of the photosensitive drum 29 is transferred onto the sheet 3 by a transfer bias applied to the transfer roller 32, while the sheet 3 conveyed by the registration roller 14 passes through a transfer position between the photosensitive drum 29 and the transfer roller 32, as shown in FIG. 1. The sheet 3 to which the toner image is transferred is conveyed to the fixing portion 21.

The transfer residual toner remaining on the photosensitive drum 29 after transfer is collected by the developing roller 41. Also, paper powder from the sheet 3 adhering on the photosensitive drum 29 after transfer is collected by the cleaning brush 33.

The fixing portion 21 is provided in the rear of the process cartridge 20, and has a fixing frame 48, and a heating roller 49 and a pressure roller 50 within the fixing frame 48.

The heating roller 49 has a metallic tube having the surface coated with fluororesin, and a tungsten halogen lamp for heating within the metallic tube, and is rotated and driven by inputting a motive force from the motor, not shown.

The pressure roller 50 is disposed oppositely under the heating roller 49 to press the heating roller 49. This pressure roller 50 is constituted by covering a metallic roller shaft with a roller made of rubber material, and driven by rotating and driving the heating roller 49.

In the fixing portion 21, the toner transferred onto the sheet 3 at the transfer position is thermally fixed while the sheet 3 is passing between the heating roller 49 and the pressing roller 50. The sheet 3 having the toner fixed is conveyed on a sheet discharge path 51 extending vertically toward the upper face of the main body casing 2. The sheet 3 conveyed on the sheet discharge path 51 is discharged onto a sheet discharge tray 53 formed on the upper face of the main body casing 2 by a sheet discharge roller 52 provided on its upper side.

The constitution of the toner agitation device 65 will be described below in detail. FIG. 4 and FIGS. 6 to 8 are side cross-sectional views of the accommodation case 60 and the agitator 64 making up the toner agitation device 65, and FIG. 5 is a perspective view of the agitator 64.

Figure 4:
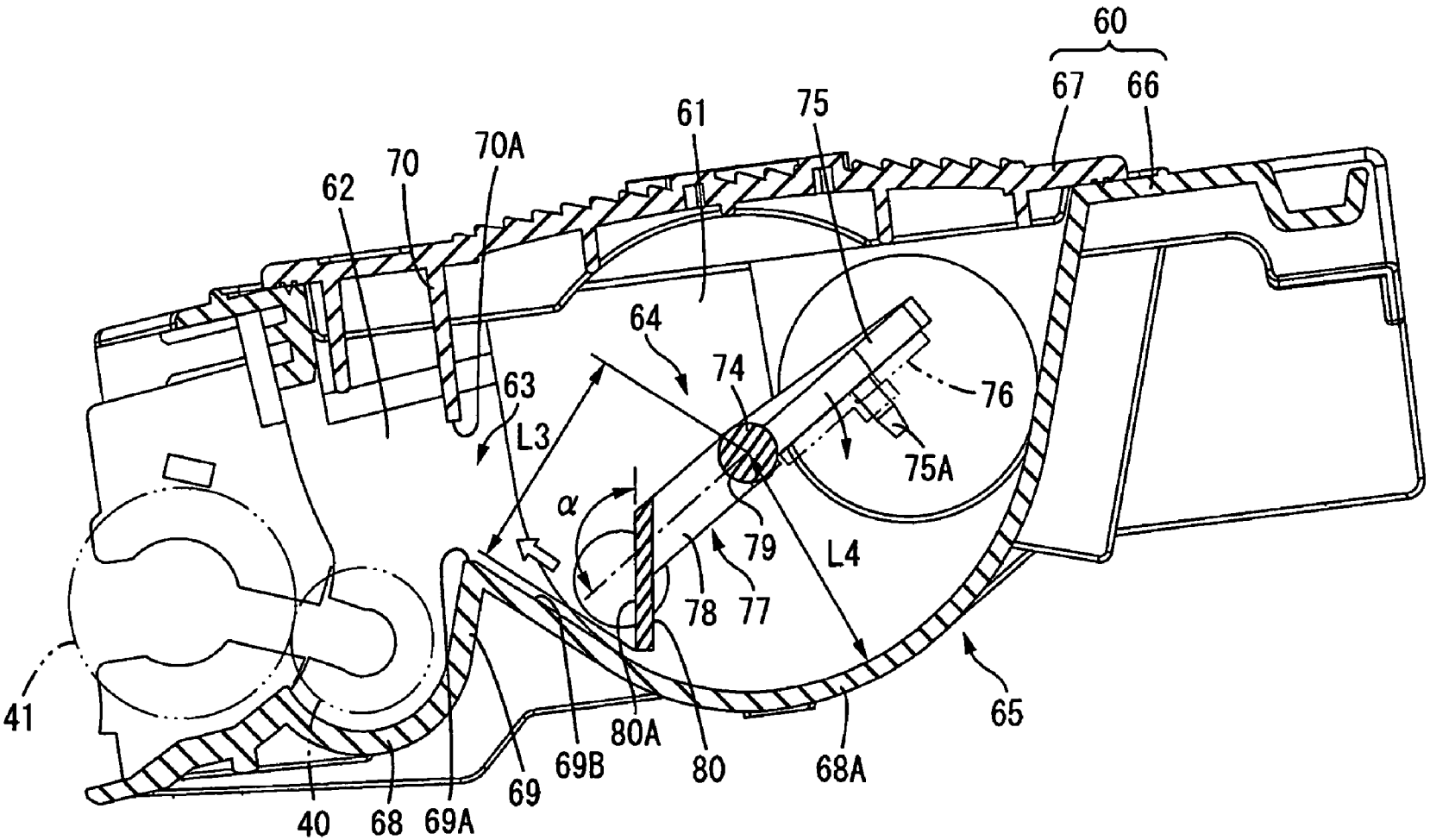
FIG. 4 is a side cross-sectional view of an agitator and an accommodation case when a distal end of an agitation plate is located near a rear end of an arcuate wall.
Figure 5:
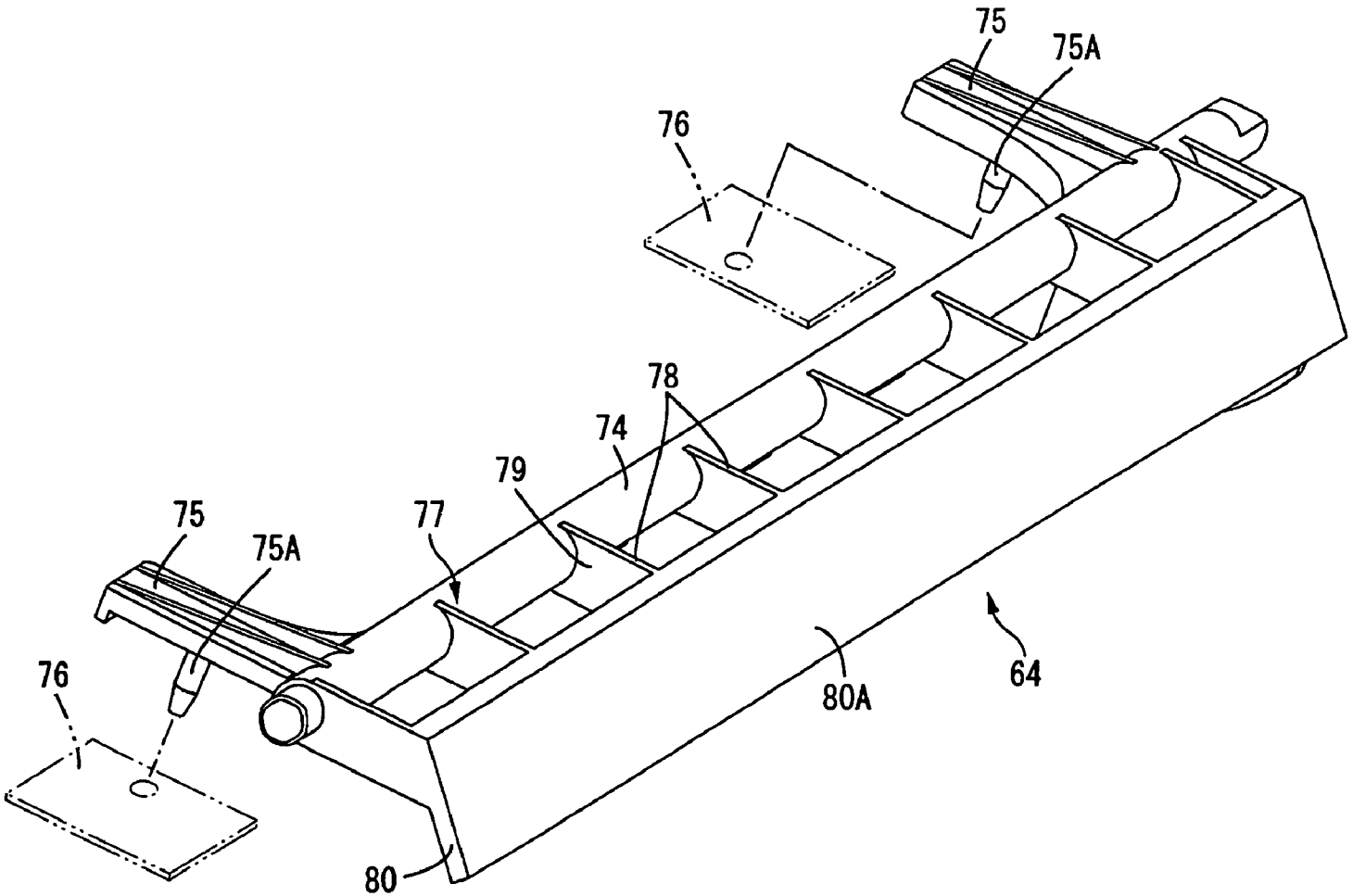
FIG. 5 is a perspective view of the agitator.

The accommodation case 60 is formed like a long box extending laterally and made of a synthetic resin material such as ABS resin, and has a case main body portion 66 in which the rear face and the upper face are partially opened and a lid portion 67 incorporated to cover an opening on the upper face of the case main body portion 66, as shown in FIG. 4. The case main body portion 66 has a bottom wall 68 that covers the lower face in an inner space of the accommodation case 60. In the toner storage chamber 61 formed in front in the inner space of the accommodation case 60, the shaft portion 74 of the agitator 64 is supported along the lateral direction. On the bottom wall 68 on the side of the toner storage chamber 61, an arcuate wall 68A like a circular arc in cross section centered at the shaft portion 74 is formed in a range from the front of the shaft portion 74 to the obliquely lower rear of the shaft portion 74. The toner storage chamber 61 takes the form in which a cylindrical space having a radius of the length from the shaft portion 74 to the arcuate wall 68A with a center of the shaft portion 74 is slightly expanded to the rear and the obliquely upper front as a whole. A lower partition wall 69 projecting upwards like a crest in cross section is formed continuously in the rear of the arcuate wall 68A, whereby an upper face in an area from a vertex portion (a lower opening edge part 69A of the toner supply opening 63) of this lower partition wall 69 to the rear end of the arcuate wall 68A becomes a flat feed plane 69B that is inclined along a tangential direction of the circle centered at the shaft portion 74.

Above the lower partition wall 69, an upper partition wall 70 like a plate extends downwards from a lower face of the lid portion 67, whereby the toner storage chamber 61 and the developing chamber 62 are longitudinally partitioned by the upper partition wall 70 and the lower partition wall 69. The toner supply opening 63 is formed between the lower opening edge part 69A at the upper end of the lower partition wall 69 and the upper opening edge part 70A at the lower end of the upper partition wall 70, whereby the toner storage chamber 61 and the developing chamber 62 communicate via the toner supply opening 63. The toner supply opening 63 is disposed at a rear position of the shaft portion 74, and downstream in the rotational direction (clockwise direction in FIG. 4) of the agitator 64 with respect to the arcuate wall 68A covering the bottom of the toner storage chamber 61. Also, the lower opening edge part 69A of the toner supply opening 63 is provided at a lower position than the shaft portion 74, and the upper opening edge part 70A is provided at a higher position than the shaft portion 74. The inner width sizes of the toner storage chamber 61, the developing chamber 62 and the toner supply opening 63 in the lateral direction are almost the same.

On the left and right side walls of the case main body portion 66, the window holes 71 (see FIG. 6) for detecting the residual amount of toner are provided at a position in front of the lower partition wall 69 and obliquely downward in the rear of the shaft portion 74 in the toner storage chamber 61. Each window hole 71 is covered and closed with a transparent window member 72. The main body casing 2 is provided with a light emitting element (not shown) outside one of the window holes 71 and a light receiving element (not shown) outside the other window hole 71. A detection light emitted from the light emitting element and transmitted through the accommodation case 60 is detected by the light receiving element to determine the presence or absence of the toner depending on its output value.

The agitator 64 is integrally formed of a synthetic resin material such as ABS resin, and as a whole, has such a rigidity that it is not deformed by a pressure from the toner at the time of driving the rotation. This agitator 64 has the shaft portion 74 like a round bar as the rotation shaft. When both the end portions of this shaft portion 74 are fitted into bearing holes (not shown) provided on both the left and right side walls of the toner storage chamber 61, the agitator 64 is supported for free rotation around the shaft portion 74 in a horizontal attitude along the lateral direction as shown in FIGS. 4 and 5. On a left outside face of the accommodation case 60, a gear mechanism (not shown) is provided to transmit a motive force from the motor, not shown, to the shaft portion 74 so that the agitator 64 is rotated and driven in the clockwise direction in FIG. 4.

On the outer circumferential faces of the shaft portion 74 near both the left and right end portions, wiper mounting portions 75 like a plate are provided radially outwards and extend in the same direction. Each wiper mounting portion 75 has a mounting pin 75A projecting from a downstream face in the rotational direction. A wiper 76 like a rectangle made of urethane rubber is attached on each mounting pin 75A, with its one end jutting out in the direction of the shaft portion 74. Each wiper 76 slides on the surface of the window member 72 to wipe the toner adhering to the surface, along with the rotation of the shaft portion 74.

On the outer circumferential face of the shaft portion 74, a connection portion 77 is provided on the opposite side of the wiper mounting portion 75 and extends radially outwards. This connection portion 77 has a plurality of plate pieces 78 vertical to the shaft portion 74, which are arranged at an almost regular interval in the direction of the shaft portion 74 over the roughly entire width of the toner storage chamber 61, each plate piece supporting an agitation plate 80 at the distal end thereof. Also, a rectangular through hole 79 penetrating in the tangential direction of rotation is formed between adjacent plate pieces 78. These through holes 79 are provided in parallel almost evenly in the direction of the shaft portion 74.

The agitation plate 80 is like a rectangular flat plate having a width size over the roughly entire width of the toner storage chamber 61, and extends radially outwards of the shaft portion 74 from the distal end of the connection portion 77. In this agitation plate 80, a face on the downstream side in the rotational direction is an outward inclined face 80A that is inclined gradually toward the upstream side in the rotational direction as it extends to its distal end. The angle $\alpha$ (see FIG. 4) made between the inclined face 80A and the extension direction of the connection portion 77 is 130.5°. The angle $\alpha$ can be set in a range $90° < \alpha < 180°$. Also, the length L1 (see FIG. 8) from the outer end portion (opposite end portion of the shaft portion 74) of the inclined face 80A to the inner end portion (end portion of the shaft portion 74) is 11.5 mm, and the length L2 from the inner end portion of the inclined face 80A to the shaft portion 74 is 10.5 mm, whereby the length L1 is set to be larger than the length L2.

Moreover, the length L3 from the center of the shaft portion 74 to the distal end of the agitation plate 80 is 19.0 mm, and the length L4 from the center of the shaft portion 74 to the inner face of the arcuate wall 68A is 20.0 mm, whereby the length L3 is set to be slightly smaller than the length L4, as shown in FIG. 4. Therefore, the agitator 64 is rotated and driven always out of contact with the inner wall face of the toner storage chamber 61, whereby the top of the agitation plate 80 passes extremely near the arcuate wall 68A.

Figure 6:
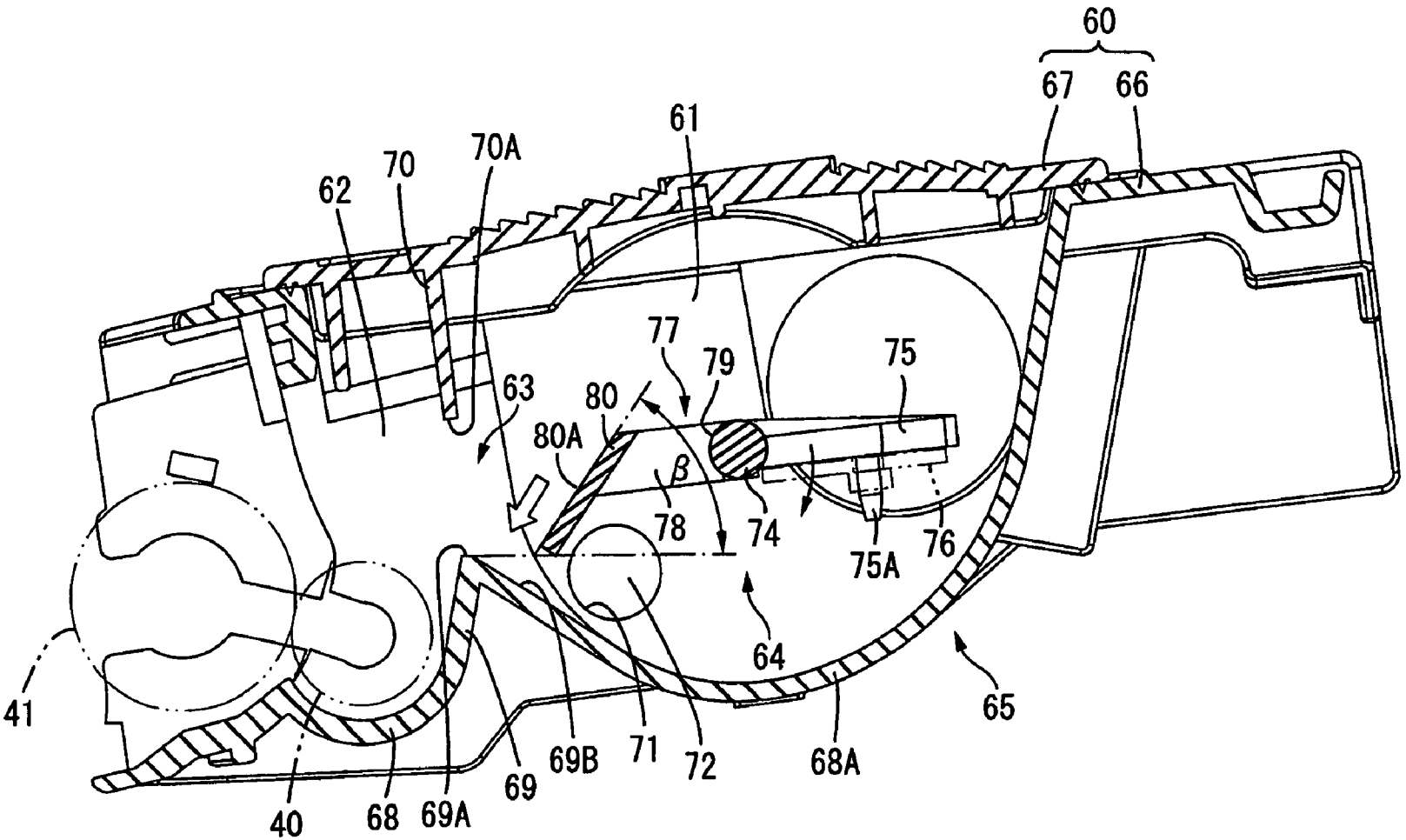
FIG. 6 is a side cross-sectional view of the agitator and the accommodation case when the distal end of the agitation plate is located at the same height position as a lower opening edge part of a toner supply opening.

Also, when the distal end of the agitation plate 80 reaches a position of the same height as the lower opening edge part 69A of the toner supply opening 63, the inclination angle $\beta$ of the inclined face 80A to the horizontal line is 55.7°, as shown in FIG. 6. The angle $\beta$ can be set in a range from 20° to 80°.

Figure 7:
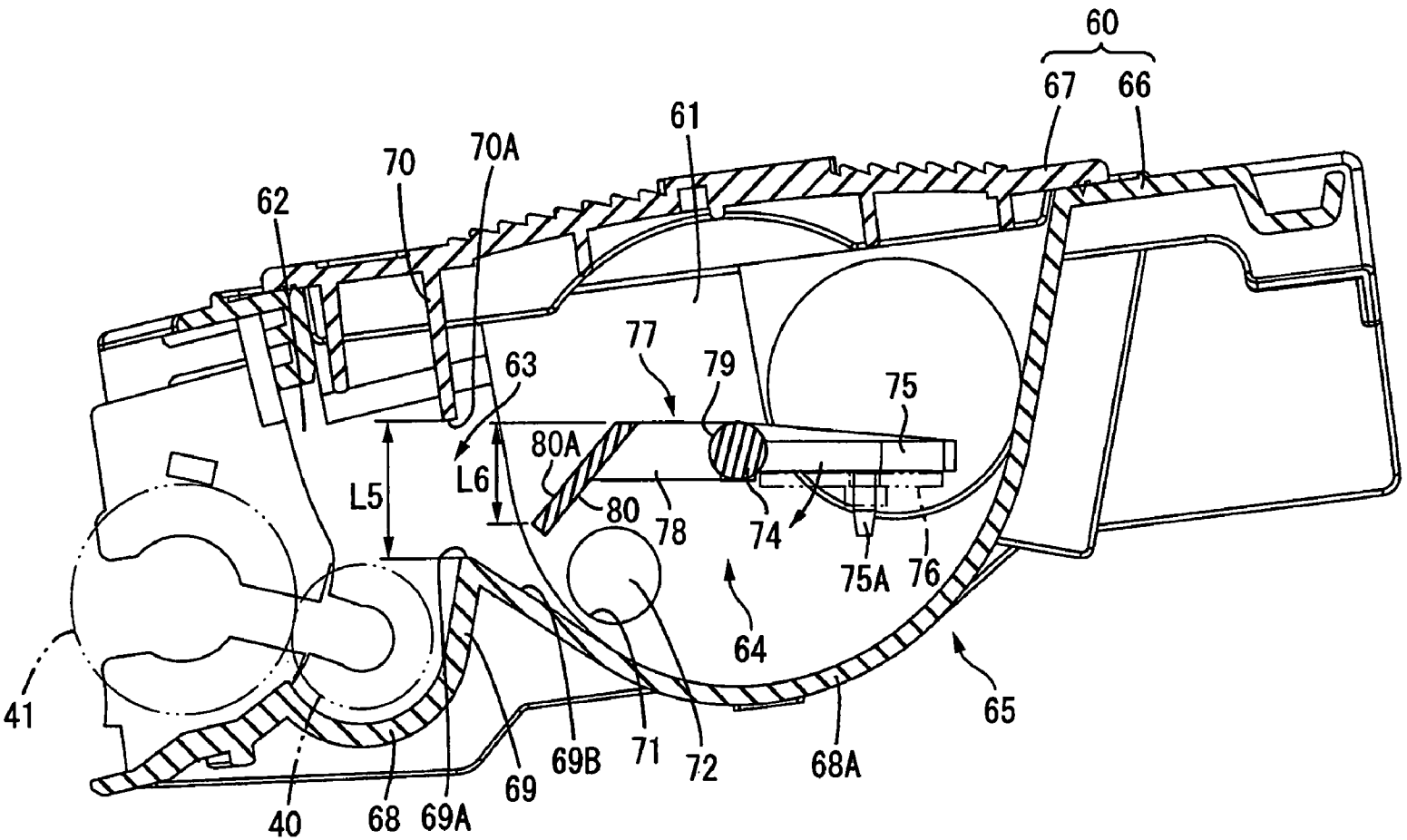
FIG. 7 is a side cross-sectional view of the agitator and the accommodation case when an inner end portion of an inclined face is located at the same height position as an upper side opening edge part of the toner supply opening.

Moreover, the height L5 of the toner supply opening 63 is 11.8 mm, and the height L6 of the inclined face 80A is 8.7 mm when the inner end portion of the inclined face 80A is at a position of the same height as the upper opening edge part 70A of the toner supply opening 63, as shown in FIG. 7. In other words, when the inner end portion of the inclined face 80A is at a position of the same height as the upper opening edge part 70A of the toner supply opening 63, the outer end portion of the inclined face 80A is set at a higher position than the lower opening edge part 69A of the toner supply opening 63.

Figure 8:
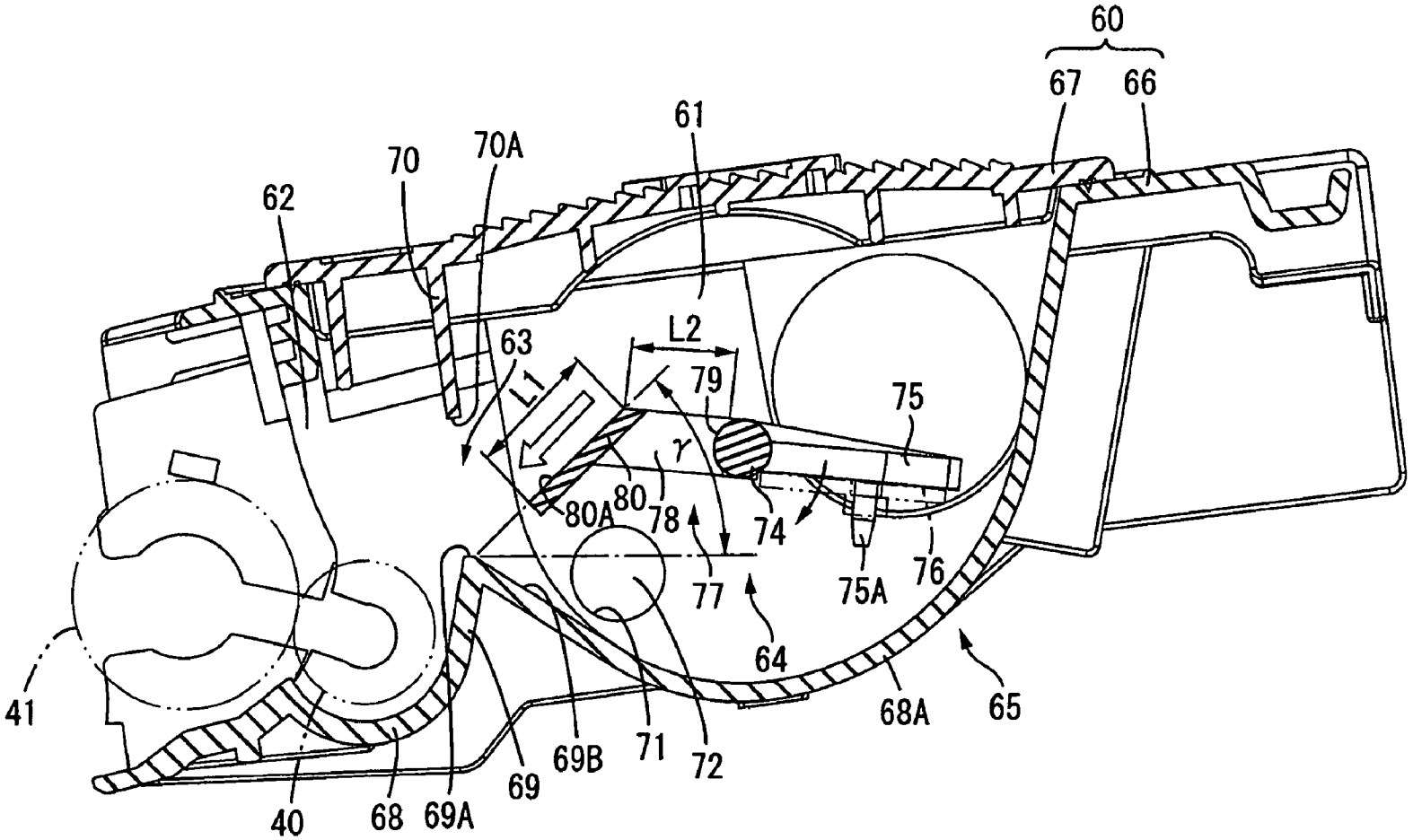
FIG. 8 is a side cross-sectional view of the agitator and the accommodation case when the lower opening edge part of the toner supply opening is located on the extension line of the inclined face.

Also, when the lower opening edge part 69A of the toner supply opening 63 reaches on the extension line of the inclined face 80A, the inclination angle γ of the inclined face 80A to the horizontal line is 44.0°, as shown in FIG. 8. The angle γ can be set in a range from 20° to 80°.

The operation of agitating and supplying the toner by the toner agitation device 65 will be described below.

The agitator 64 is rotated and driven at a rate of one rotation per second, for example, by a motive force from the motor, not shown. When the distal end of the agitation plate 80 is moved from the front end position of the arcuate wall 68A to the rear end, the toner deposited on the bottom of the toner storage chamber 61 is accordingly pressed downstream in the rotational direction by the inclined face 80A, and scraped from the feeding face 69B to the toner supply opening 63, as indicated by the arrow in FIG. 4. Along with the rotation of the agitator 64, most of the toner near the shaft portion 74 passes through the through holes 79 provided in the connection portion 77 from the downstream side to the upstream side in the rotational direction.

When the agitator 64 is further rotated from the state of FIG. 4 and the distal end of the agitation plate 80 reaches near the toner supply opening 63, more specifically, when the distal end of the agitation plate 80 reaches a position of the same height as the lower opening edge part 69A of the toner supply opening 63 (see FIG. 6), or when the lower opening edge part 69A reaches on the extension line of the inclined face 80A (see FIG. 8), the toner scraped by the inclined face 80A is conveyed to the side of the toner supply opening 63 to slide down the inclined face 80A (see the arrow in FIG. 6 or 8), because the inclined face 80A is inclined to descend to the side of the toner supply opening 63. When the agitation plate 80 passes near the toner supply opening 63, the toner conveyed by the inclined face 80A smoothly flows into the toner supply opening 63, because the height size of the toner supply opening 63 is larger than the height size of the inclined face 80A (see FIG. 7).

When there is any residual toner without falling from the inclined face 80A into the toner supply opening 63 while the agitation plate 80 passes near the toner supply opening 63, the toner is lifted as the agitation plate 80 is raised, and then falls from the inclined face 80A to be mixed with the toner deposited on the bottom.

According to the above embodiment, since the agitator 64 comprises the agitation plate 80 for agitating and supplying the toner, and the connection portion 77 for connecting the agitation plate 80 with the shaft portion 74, which are integrally formed of the same material, the number of parts is reduced and the manufacturing cost required for assembling the parts is suppressed.

Also, since the downstream face of the agitation plate 80 in the rotation direction is the inclined face 80A that is inclined gradually toward the upstream side in the rotational direction as it extends to its distal end, the toner is conducted radially outwards by the inclined face 80A, when the agitator 64 is rotated and driven. Thereby, the toner within the toner storage chamber 61 is efficiently conveyed into the toner supply opening 63.

Also, since the inclined face 80A is inclined to gradually descend closer to the distal end when the distal end of the agitation plate 80 reaches a position of the same height as the lower opening edge part 69A of the toner supply opening 63 (see FIG. 6), the toner scraped by the inclined face 80A is conveyed to the side of the toner supply opening 63 to slide down the inclined face 80A even in a state where the residual amount of toner is small.

Also, the inclination angle of the inclined face 80A to the horizontal line is set to be from 20° to 80° when the distal end of the agitation plate 80 reaches a position of the same height as the lower opening edge part 69A of the toner supply opening 63 (see FIG. 6). Herein, when the inclination angle of the inclined face 80A is intense, the force for conveying the toner to the side of the toner supply opening 63 is great, but the amount of toner conveyed is small. Also, when the inclination angle of the inclined face 80A is gentle, the opposite occurs. Therefore, when the inclination angle of the inclined face 80A is from 20° to 80° as in this embodiment, the toner can be conveyed into the toner supply opening 63 most efficiently.

Also, since the inclined face 80A is inclined to gradually descend closer to the distal end when the lower opening edge part 69A of the toner supply opening 63 reaches on its extension line (see FIG. 8), the toner scraped by the inclined face 80A is conveyed to the side of the toner supply opening 63 to slide down the inclined face 80A even in a state where the residual amount of toner is small.

Also, the inclination angle of the inclined face 80A to the horizontal line is set to be from 20° to 80° when the lower opening edge part 69A of the toner supply opening 63 reaches on the extension line of the inclined face 80A. Herein, when the inclination angle of the inclined face 80A is intense, the force for conveying the toner to the side of the toner supply opening 63 is great, but the amount of toner conveyed is small. Also, when the inclination angle of the inclined face 80A is gentle, the opposite occurs. Therefore, when the inclination angle of the inclined face 80A is from 20° to 80° as in this embodiment, the toner can be conveyed into the toner supply opening 63 most efficiently.

Also, when the inner end portion of the inclined face 80A is at a position of the same height as the upper opening edge part 70A of the toner supply opening 63, the outer end portion of the inclined face 80A is set at a higher position than the lower opening edge part 69A of the toner supply opening 63. That is, since the height size of the toner supply opening 63 is set to be larger than the height size of the inclined face 80A, the toner conveyed by the inclined face 80A smoothly flows into the toner supply opening 63.

Also, since the length L1 from the outer end portion of the inclined face 80A to the inner end portion is set to be larger than the length from the inner end portion of the inclined face 80A to the shaft portion 74, the length (area) of the inclined face 80A is kept so that the toner can be agitated and supplied efficiently.

Also, since the connection portion 77 is provided with the through holes 79 penetrating in the tangential direction of rotation, the pressure applied from the toner at the time of driving the rotation is reduced, and the load on a driving unit of the agitator 64 is relieved.

Also, since the plurality of through holes 79 are axially arranged in parallel in the connection portion 77, the strength is increased by the amount of the region (plate piece 78) connecting the distal end and the rotation shaft 45 provided between through holes 79, as compared with when only one through hole is provided to axially extend over the great length. Particularly in this embodiment, since the plurality of through holes 79 are axially provided almost evenly, the load on the agitator 64 at the time of driving the rotation is prevented from being deviated axially.

Also, since the agitation plate 80 of the agitator 64 is rotated and driven out of contact with the inner wall face of the toner storage chamber 61, the load is prevented from being imposed on the driving unit due to friction of the agitation plate 80 with the inner wall face of the toner storage chamber 61.

Also, since the agitator 64 is formed to have such a rigidity that it is not deformed as a whole by the pressure from the toner at least at the time of driving the rotation, the toner can be agitated and supplied more effectively than when the agitator of the same shape is formed using a flexible film.

Also, since the toner stored within the toner storage chamber 61 is the polymer toner including a non-magnetic component, the fluidity is so high that the toner can be agitated excellently by the agitator 64.

Second Embodiment

Figure 9:
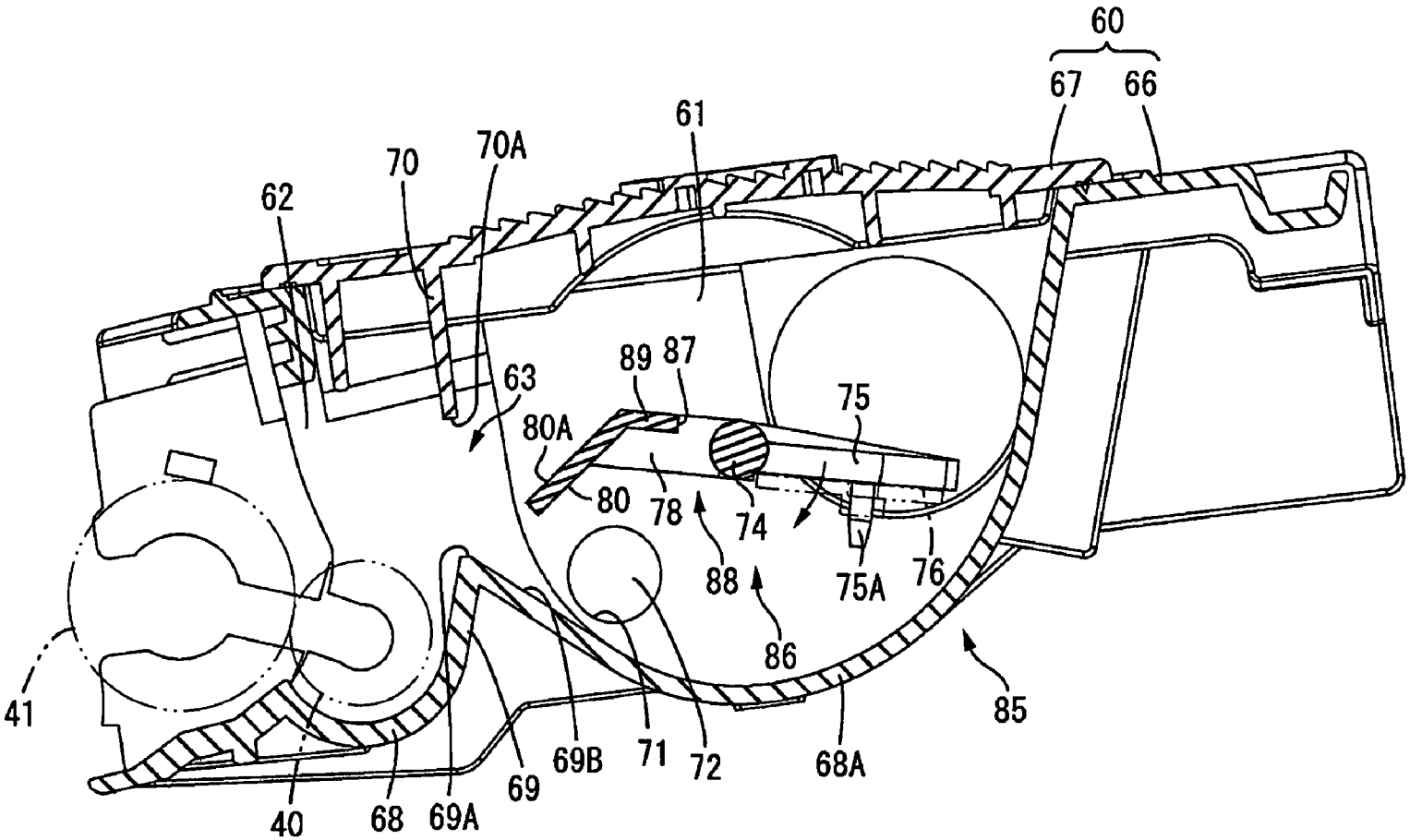
FIG. 9 is a side cross-sectional view of an agitator and an accommodation case according to a second embodiment.
Figure 10:
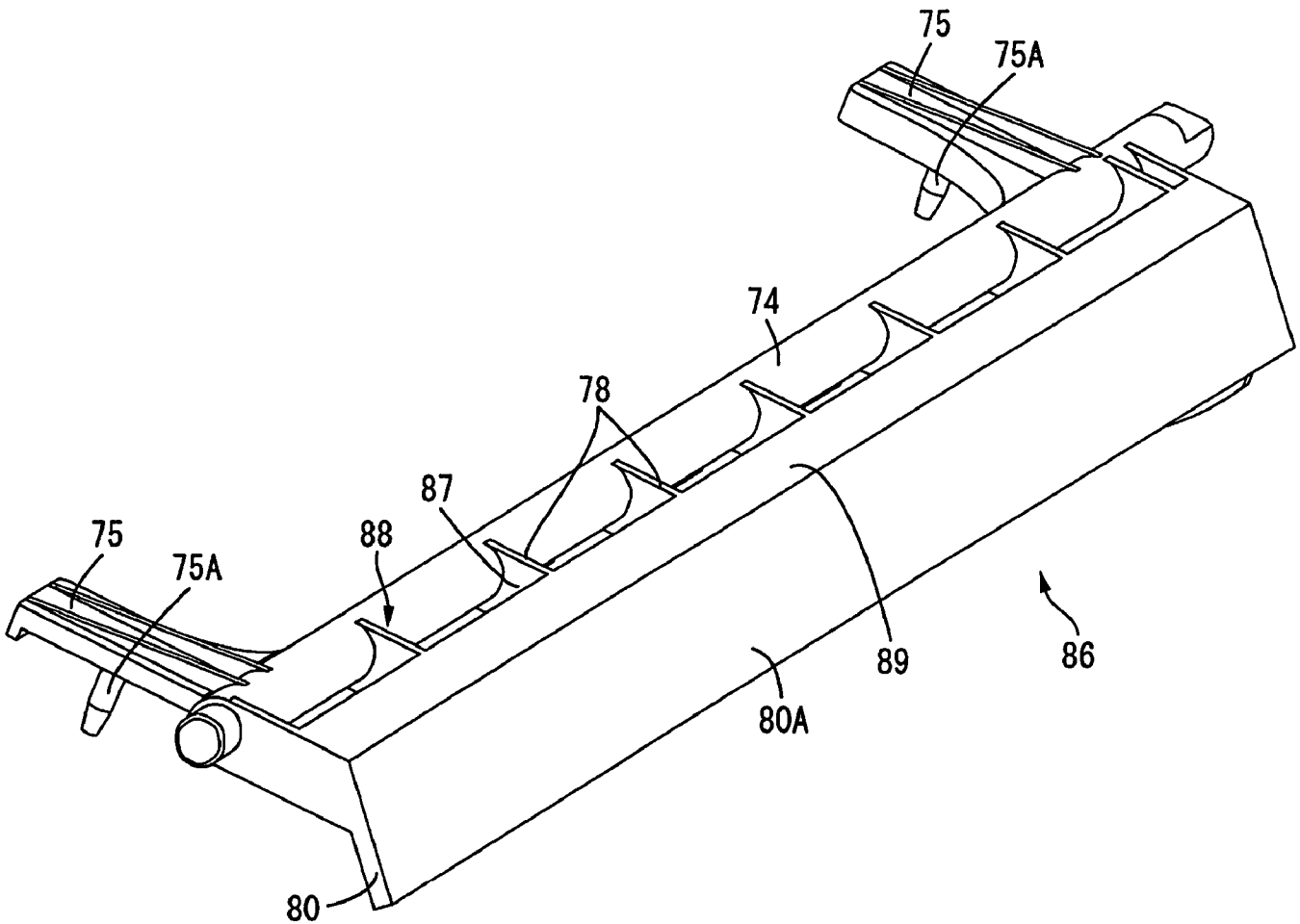
FIG. 10 is a perspective view of the agitator.

Referring to FIGS. 9 and 10, a second embodiment of the invention will be described below. FIG. 9 is a side cross-sectional view of an accommodation case 60 and an agitator 86 making up a toner agitation device 85 according to this embodiment, and FIG. 10 is a perspective view of the agitator 86.

The agitator 86 of this embodiment is provided with a plurality of through holes 87 only at the positions close to the shaft portion 74 in a connection portion 88. Each through hole 87 is provided to penetrate in the tangential direction of rotation. The through holes are disposed almost evenly in the direction of the shaft portion 74. Also, at the distal end of the connection portion 88, an agitation face 89 vertical to the tangential direction of rotation is formed continuously to the inner end portion of the inclined face 80A. The other constitution is the same as in the first embodiment, whereby the same or like parts are designated by the same numerals as in the first embodiment, and the explanation of the same parts is omitted.

When this agitator 86 is rotated and driven, the toner near the shaft portion 74 passes through each through hole 87 of the connection portion 88 from the downstream side to the upstream side in the rotation direction. Also, the toner deposited on the bottom of the toner storage chamber 61 is pressed toward the downstream side in the rotation direction due to the agitation face 89 of the connection portion 88, and a part of the toner is laid on the agitation face 89 and lifted up, then falling from the agitation face 89 to be mix with the toner deposited on the bottom.

As described above, with this embodiment, since the plurality of through holes 87 are provided only at the positions close to the shaft portion 74 in the connection portion, the toner is effectively agitated even at the distal end of the connection portion 88 while suppressing the load on the driving unit of the agitator 86. If the through holes are provided only at the positions close to the distal end, the toner is agitated only in the region close to the shaft portion 74, although the effect of reducing the load of the driving unit is expected. Therefore, especially when the residual amount of toner is small, the toner is unlikely to be laid on the region close to the shaft portion 74, whereby it is not expected that the toner is effectively agitated according to the embodiment, on the other hand, both the effects can be expected.

Although the invention has been described above based on its embodiments, the invention is not limited thereto. The invention can be improved or modified variously without departing from the gist of the invention. For example, though the agitator is formed of synthetic resin in the above embodiment, the agitator may be formed of metalic material.

What is claimed is:

1. A cartridge comprising:

a toner storage chamber provided with a toner supply opening; and a toner agitation member including a connection portion configured to rotate around a rotation shaft within the toner storage chamber and extending radially outward from the rotation shaft; and an agitation plate, provided at a distal end of the connection portion, and configured to scrape a toner deposited on a bottom of the toner storage chamber and to supply the scraped toner to the toner supply opening as the connection portion is rotated, the connection portion and the agitation plate being integrally formed of the same material, wherein a face of the agitation plate on a downstream side in a rotation direction is an inclined face that is inclined toward an upstream side in the rotation direction as the inclined face extends from the connection portion to a distal end of the agitation plate, wherein when the distal end of the agitation plate reaches a position of the same height as a lower opening edge part of the toner supply opening, the inclined face is inclined to gradually descend toward its distal end, wherein when the distal end of the agitation plate reaches a position of the same height as the lower opening edge part, an inclination angle of the inclined face is from 20° to 80° relative to a horizontal axis, and wherein the agitation plate is configured to rotate without contacting an inner wall face of the toner storage chamber.

2. The cartridge according to claim 1, further comprising a developing unit for developing an electrostatic latent image formed on an image carrier with the toner supplied through the toner supply opening.

3. The cartridge according to claim 2, wherein the toner stored in the toner storage chamber is a polymer toner including a non-magnetic component polymer toner.

4. The cartridge according to claim 1, further comprising:

an image carrier on which an electrostatic latent image is formed; and a developing unit for developing the electrostatic latent image formed on the image carrier with the toner supplied through the toner supply opening.

5. The cartridge according to claim 1, wherein when the lower opening edge part of the toner supply opening reaches an extension line of the inclined face, the inclined face slopes downward toward its distal end.

6. The cartridge according to claim 5, wherein when the lower opening edge part of the toner supply opening reaches the extension line of the inclined face, an inclination angle of the inclined face to a horizontal line is from 20° to 80°.

7. The cartridge according to claim 1, wherein when a base end, which is opposite to the distal end, of the inclined face is at a position of the same height as an upper opening edge part of the toner supply opening, the distal end of the inclined face is set to be at a higher position than the lower opening edge part of the toner supply opening.

8. The cartridge according to claim 1, wherein a length dimension from the distal end to a base end, which is opposite to the distal end, of the inclined face is set to be larger than a length dimension from the base end of the inclined face to the rotation shaft.

9. The cartridge according to claim 1, wherein the connection portion includes a penetrating through hole in a tangential direction of rotation.

10. The cartridge according to claim 9, wherein the through hole comprises a plurality of through holes arranged along a direction in parallel with the rotation shaft.

11. The cartridge according to claim 10, wherein the plurality of through holes are provided only at positions in vicinity of the rotation shaft of the connection portion.

12. The cartridge according to claim 1, wherein the toner agitation member is sufficiently rigid to withstand substantial deformation by a pressure applied from the toner during a rotation of the toner agitation member.

13. An image forming apparatus comprising:

a toner storage chamber provided with a toner supply opening;

a toner agitation member including:

a connection portion configured to rotate around a rotation shaft within the toner storage chamber and extending radially outwards from the rotation shaft; and an agitation plate, provided at a distal end of the connection portion, configured to scrape a toner deposited on a bottom of the toner storage chamber and to supply the scraped toner to the toner supply opening as the connection portion is rotated, the connection portion and the agitation plate being integrally formed of the same material, wherein a face of the agitation plate on a downstream side in a rotation direction is an inclined face that is inclined toward an upstream side in the rotation direction as the inclined face extends from the connection portion to a distal end of the agitation plate, wherein when the distal end of the agitation plate reaches a position of the same height as a lower opening edge part of the toner supply opening, the inclined face is inclined to gradually descend toward its distal end, wherein when the distal end of the agitation plate reaches a position of the same height as the lower opening edge part, an inclination angle of the inclined face is from 20° to 80° relative to a horizontal axis, and wherein the agitation plate is configured to be rotated without contacting an inner wall face of the toner storage chamber;

an image carrier on which an electrostatic latent image is formed;

an exposure unit for exposing the electrostatic latent image by applying a laser beam to the charged image carrier;

a developing unit for developing the electrostatic latent image formed on the image carrier as a toner image with a toner supplied through the toner supply opening; and a transfer unit for transferring the toner image carried on the image carrier onto a recording medium.

14. A toner agitation member comprising:

a connection portion configured to rotate around a rotation shaft within a toner storage chamber and extending radially outwards from the rotation shaft;

an agitation plate, provided at a distal end of the connection portion, configured to scrape a toner deposited on a bottom of the toner storage chamber and to supply the scraped toner to a toner supply opening provided in the toner storage chamber as the connection portion is rotated, wherein the connection portion and the agitation plate are integrally formed of the same material, wherein a face of the agitation plate on a downstream side in a rotation direction is an inclined face that is inclined toward an upstream side in the rotation direction as the inclined face extends from the connection portion to a distal end of the agitation plate, wherein when the distal end of the agitation plate reaches a position of the same height as a lower opening edge part of the toner supply opening, the inclined face is inclined to gradually descend toward its distal end, and wherein when the distal end of the agitation plate reaches a position of the same height as the lower opening edge part, an inclination angle of the inclined face is from 20° to 80° relative to a horizontal axis.

15. A cartridge comprising:

a toner storage chamber provided with a toner supply opening; and a toner agitation member including a connection portion configured to rotate around a rotation shaft within the toner storage chamber and extending radially outward from the rotation shaft;

an agitation plate, provided at a distal end of the connection portion, and configured to scrape a toner deposited on a bottom of the toner storage chamber and to supply the scraped toner to the toner supply opening as the connection portion is rotated, the connection portion and the agitation plate being integrally formed of the same material; and a wiper mounting portion extending from the rotation shaft in a direction opposite to the connection portion and including a wiper mounting pin configured to receive a wiper.

16. The cartridge of claim 15, further comprising the wiper, wherein the wiper is configured to make sliding contact with a side of the toner storage chamber.

* * * * *